United States Patent [19]

Gallis et al.

[11] Patent Number: 4,473,209

[45] Date of Patent: Sep. 25, 1984

[54] PREFABRICATED WALL FORM MODULAR UNIT

[75] Inventors: Anthony J. Gallis, Lake Hiawatha; Thomas P. Kyritz, Teaneck, both of N.J.

[73] Assignee: Harsco Corporation, Camp Hill, Pa.

[21] Appl. No.: 339,774

[22] Filed: Jan. 15, 1982

[51] Int. Cl.[3] ..... E04G 17/00

[52] U.S. Cl. ..... 249/191; 249/45; 249/47; 249/193; 249/219 R

[58] Field of Search ..... 249/33, 38, 40, 44, 249/45, 47, 189, 190, 191, 192, 193, 194, 195, 196, 213, 219 R

[56] References Cited

U.S. PATENT DOCUMENTS

| | | | |
|---|---|---|---|
| 2,442,962 | 6/1948 | Rumble | 249/38 |
| 3,584,827 | 6/1971 | Shoemaker | 249/45 |
| 3,945,602 | 3/1976 | Doubleday et al. | 249/44 X |
| 4,221,357 | 9/1980 | Bowden et al. | 249/40 |

FOREIGN PATENT DOCUMENTS

| | | | |
|---|---|---|---|
| 0062420 | 10/1982 | European Pat. Off. | 249/44 |
| 1202462 | 8/1970 | United Kingdom | 249/45 |

OTHER PUBLICATIONS

Two Page Sales Advertisement, Patent Scaffolding, "New Lightweight Aluminum Forming System".

*Primary Examiner*—Jay H. Woo
*Assistant Examiner*—James C. Housel
*Attorney, Agent, or Firm*—Curtis, Morris & Safford

[57] ABSTRACT

Prefabricated modular wallform units are formed with panels designed to mate against one another and to define an aperture through which a tie rod can pass. End rails at the mating edges of the panels have webs, interior end flanges to fit against a sheet of sheathing material (e.g., plywood), and exterior end flanges to be supported against strongback walers. Elongated kerfs are formed in mating edges of the interior and exterior end flanges. These mate to define a universal through-passage suitable for any of a variety of types of tie rod. A median flange extends along the length of the mating side of the web on a line intermediate the end flanges. The median flanges are narrower than the respective end flanges and serve as distance fingers for locating the tie rods. Universal holes are also provided in the webs adjacent the median flanges and on the sides away from the interior end flanges. A T-bolt can be inserted through the universal holes of two mating end rails to join two mating panels together.

4 Claims, 12 Drawing Figures

11'
26'
32'
34'
18b'
22
24
52c
58c
54c
94
96
50c
70
72
92
90
11
3
7
8
4
18a
18b
30
32
34
28
26
81a
81
98c
82c
56c
20
42
82d
54d
80
39
40
38
44
46
48

PREFABRICATED WALL FORM MODULAR UNIT

The invention relates to prefabricated modular units for concrete wall form assemblies. More specifically, this invention relates to the improved panels which form the structural elements of modular units of concrete wall form assemblies. The invention is used in constructing large concrete structures and can be used in installations for other purposes as well.

The use of prefabricated modular units or gang sections for assembling concrete forms is known in the art. Use of gang form sections achieves substantial labor and material savings in erecting wall form installations. The structural units are pre-assembled to produce a gang of such units prior to erection. Thereafter the gangs are set into position by overhead cranes or the like. After concrete is poured and has set, the gangs are left intact and stripped from the form. They then can be reused in subsequent concrete form installations.

The gang form sections which are constructed from the improved panels of the invention and details of construction relating to such sections are described in a number of sources, including U.S. Pat. Nos. 3,067,479, 3,661,354, 3,754,729 and 4,228,986. Typically, the gang form sections are made of horizontal and vertical steel frame members which interlock with one another to make a two dimensional form which supports a plurality of rectangular plywood facings, the latter forming one surface of the intended concrete wall. Two of such two dimensional frames, the plywood facings being spaced from one another, comprise the finished concrete form into which the concrete is poured. The two frames are interconnected by tie rods which prevent the form walls from bulging under the pressure of the wet concrete poured between them. Typically, the tie rods are expendable in that after the concrete has been poured and hardened, they remain embedded in the concrete with their ends extending outwardly on either side. At points inwardly of the face of the concrete structure the tie rods are provided with nips or weakened portions, known as break backs, which facilitate breaking off the projecting ends of the rods from the surfaces of the poured concrete wall.

It is a primary object of this invention to provide improved prefabricated modular units for concrete wall form assemblies.

It is further and a more specific object of this invention to provide improved panels for forming the structural elements of such modular units.

It is a further object of this invention to provide panels which mate with the panels of adjacent modular units to form the structural cross members of the wall form and which have the flexibility of accommodating a variety of tie rods under different construction conditions.

It is still a further object of this invention to provide such panels which facilitate the dismantling of the wall form into the component modular units and the break back of the tie rods from the hardened concrete wall.

These and other objects of the invention are achieved in a prefabricated modular unit for concrete wall form assembly as shown in greater detail in the drawings described below.

Figures 2, 5, 6, 7A:
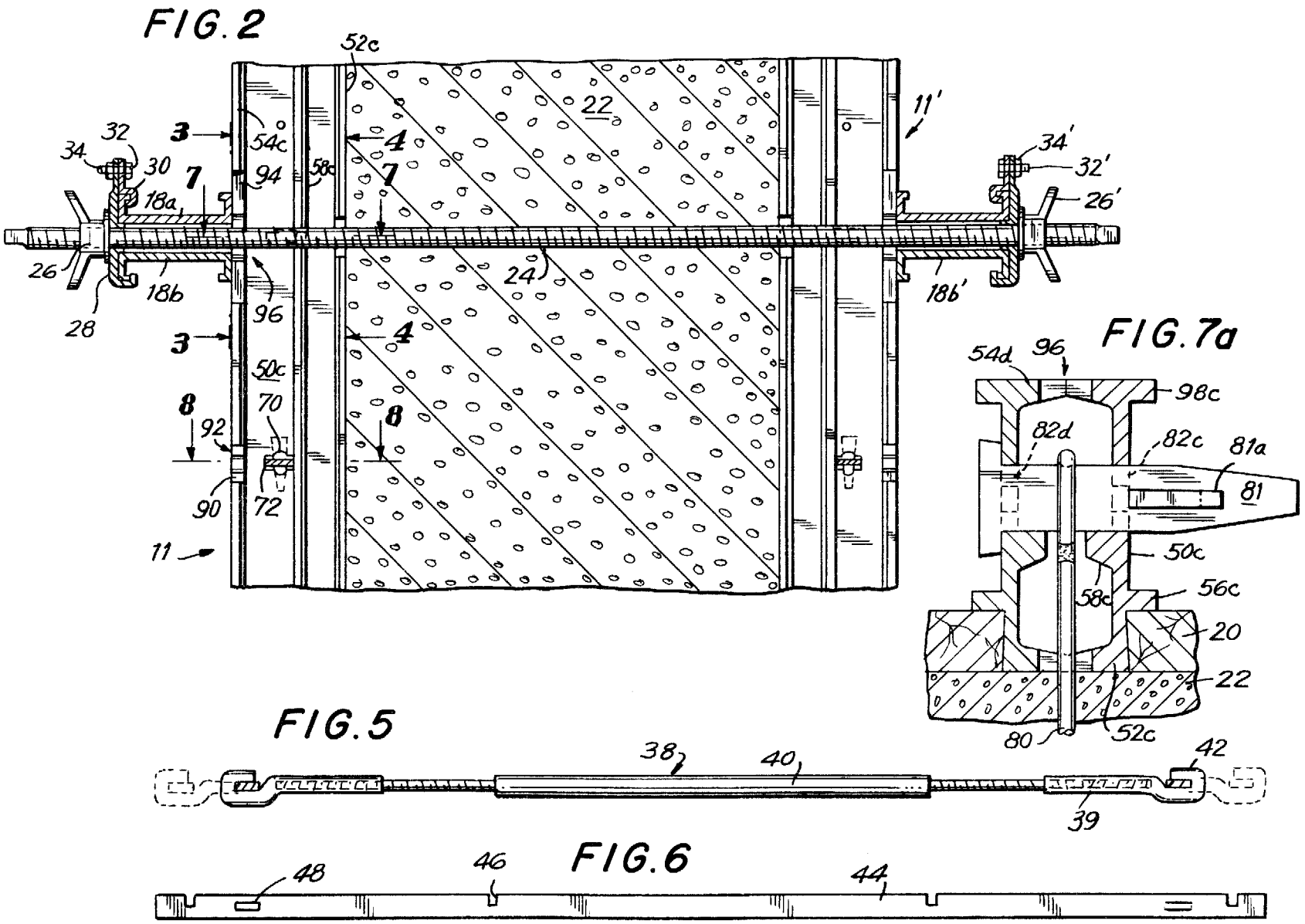
FIG. 2 is a fragmentary side elevation view (with the concrete wall insertion) of a portion of the structure shown in FIG. 1 taken along lines 2—2 of FIG. 1.
FIG. 5 is an elevation of a conventional tie rod used to connect the improved wall form assemblies of the invention.
FIG. 6 is an elevation of a second conventional tie rod used to connect the improved wall form assemblies of the invention.
Figure 7:
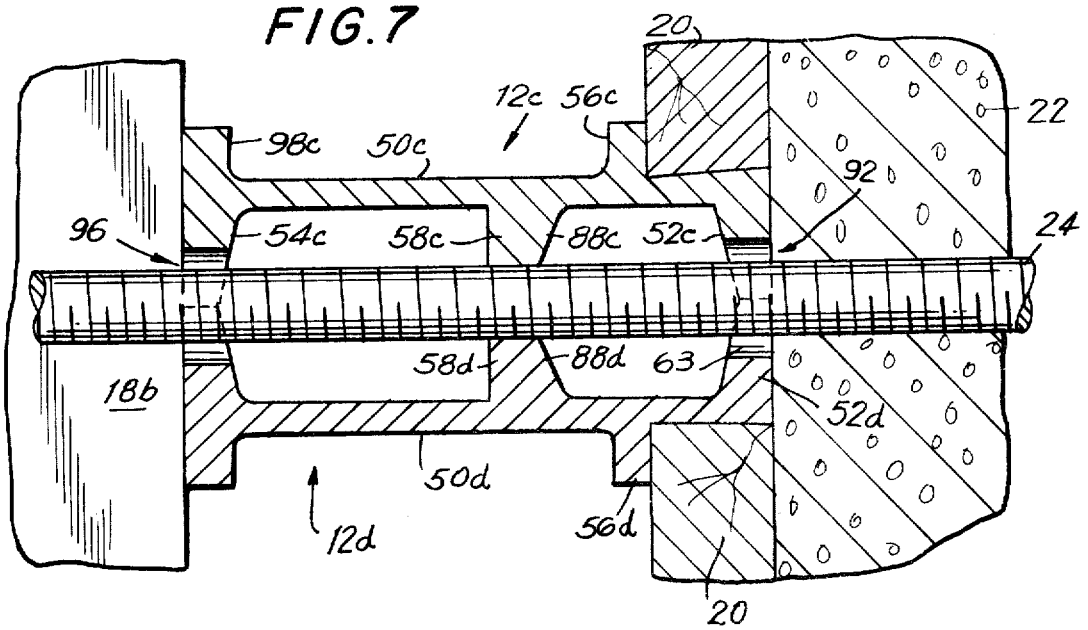
FIG. 7 is a fragmentary plan view of a portion of the structure shown in FIG. 2 taken along lines 7—7 of FIG. 2.

FIG. 7*a* is a modified view of FIG. 7 showing a modification of the structure of FIG. 7 wherein a loop tie rod is locked into a T-bolt which further serves to attach the improved panels of the invention.

Figure 8:
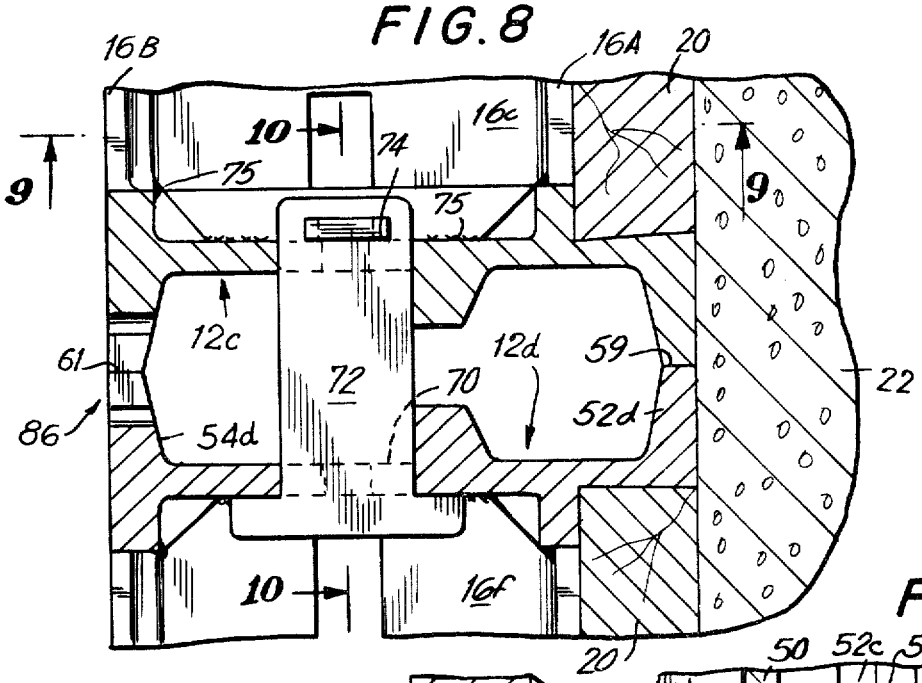

FIG. 8 is a fragmentary plan view of a portion of the structure shown in FIG. 2 taken along lines 8—8 of FIG. 2.

Figure 9:
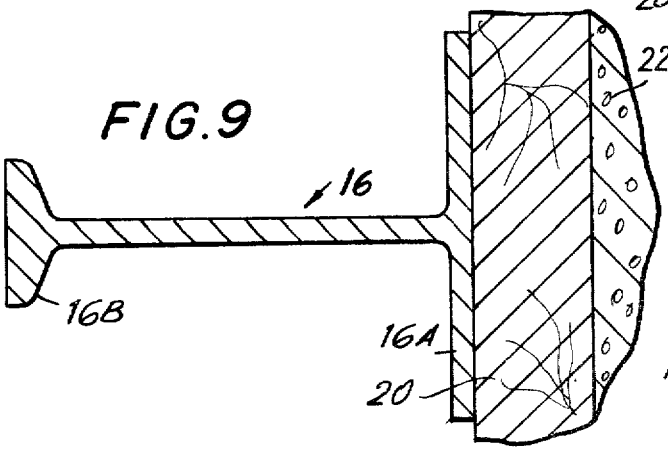

FIG. 9 is a fragmentary cross-sectional view of a portion of the structure shown in FIG. 2 taken along lines 9—9 of FIG. 8.

Figure 1:
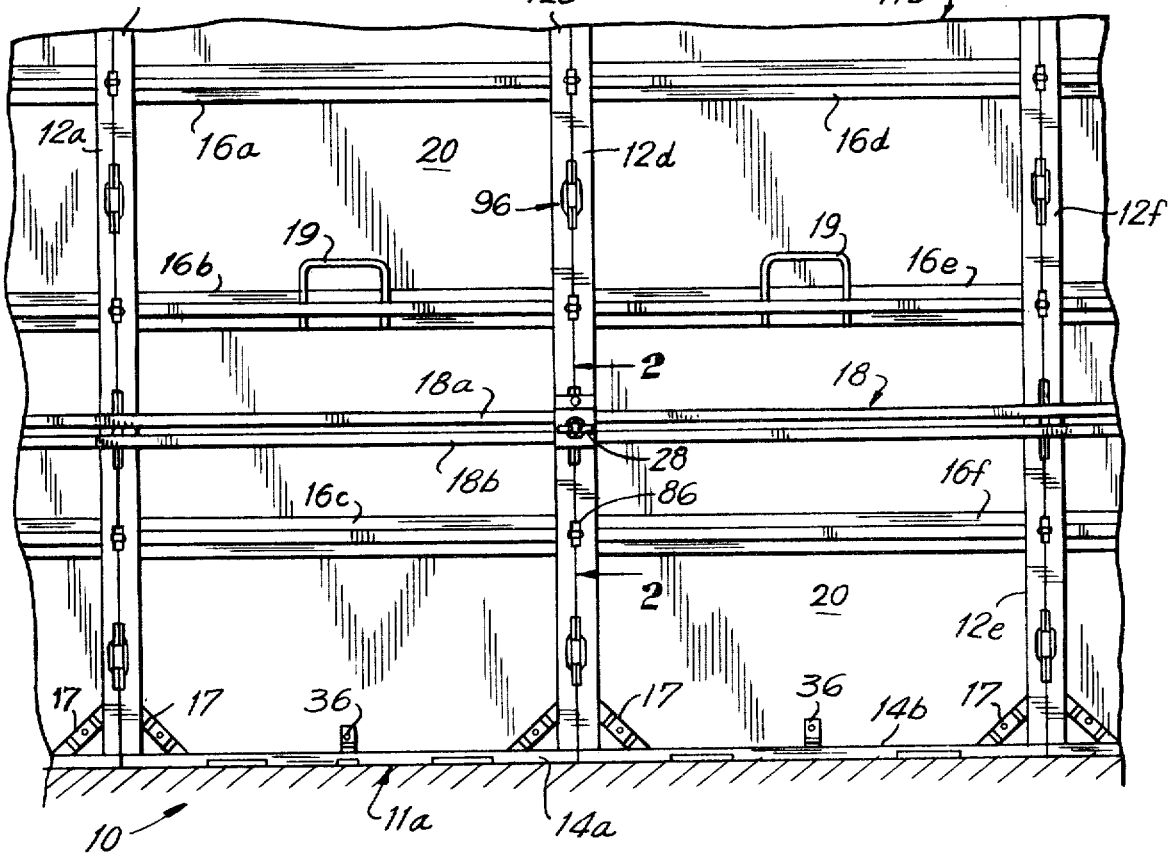
FIG. 1 is a front view of a wall form installation containing modular units in accordance with the invention.
Figure 3:
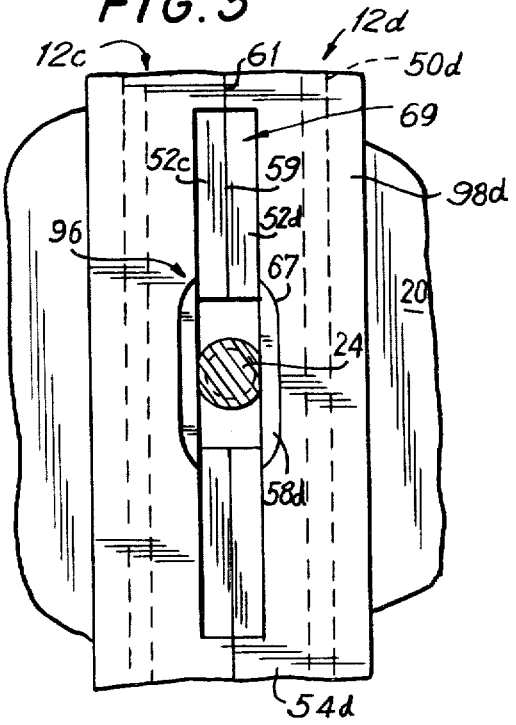
FIG. 3 is a fragmentary side elevation of a portion of the structure shown in FIG. 2 taken along lines 3—3 of FIG. 2.
Figure 4:
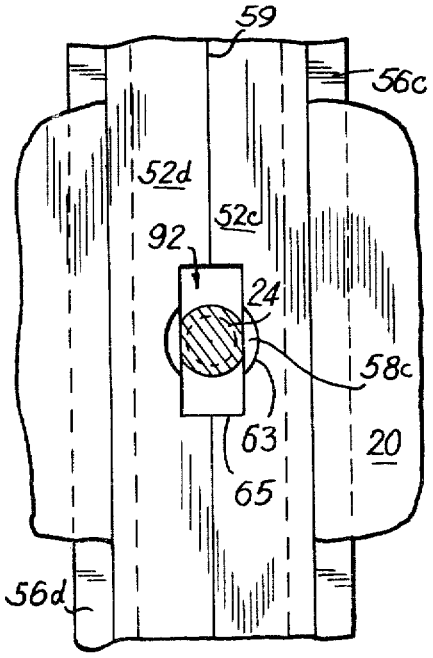
FIG. 4 is fragmentary side elevation of a portion of the structure shown in FIG. 2 taken along lines 4—4 of FIG. 2.
Figure 10:
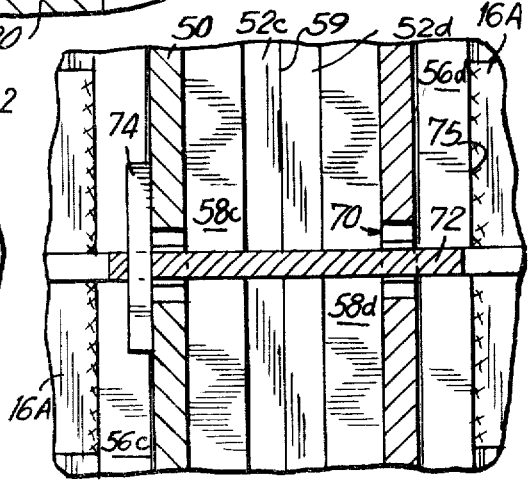

FIG. 10 is a fragmentary cross-sectional view of a portion of the structure shown in FIG. 1 taken along lines 10—10 of FIG. 8.

Figure 11:
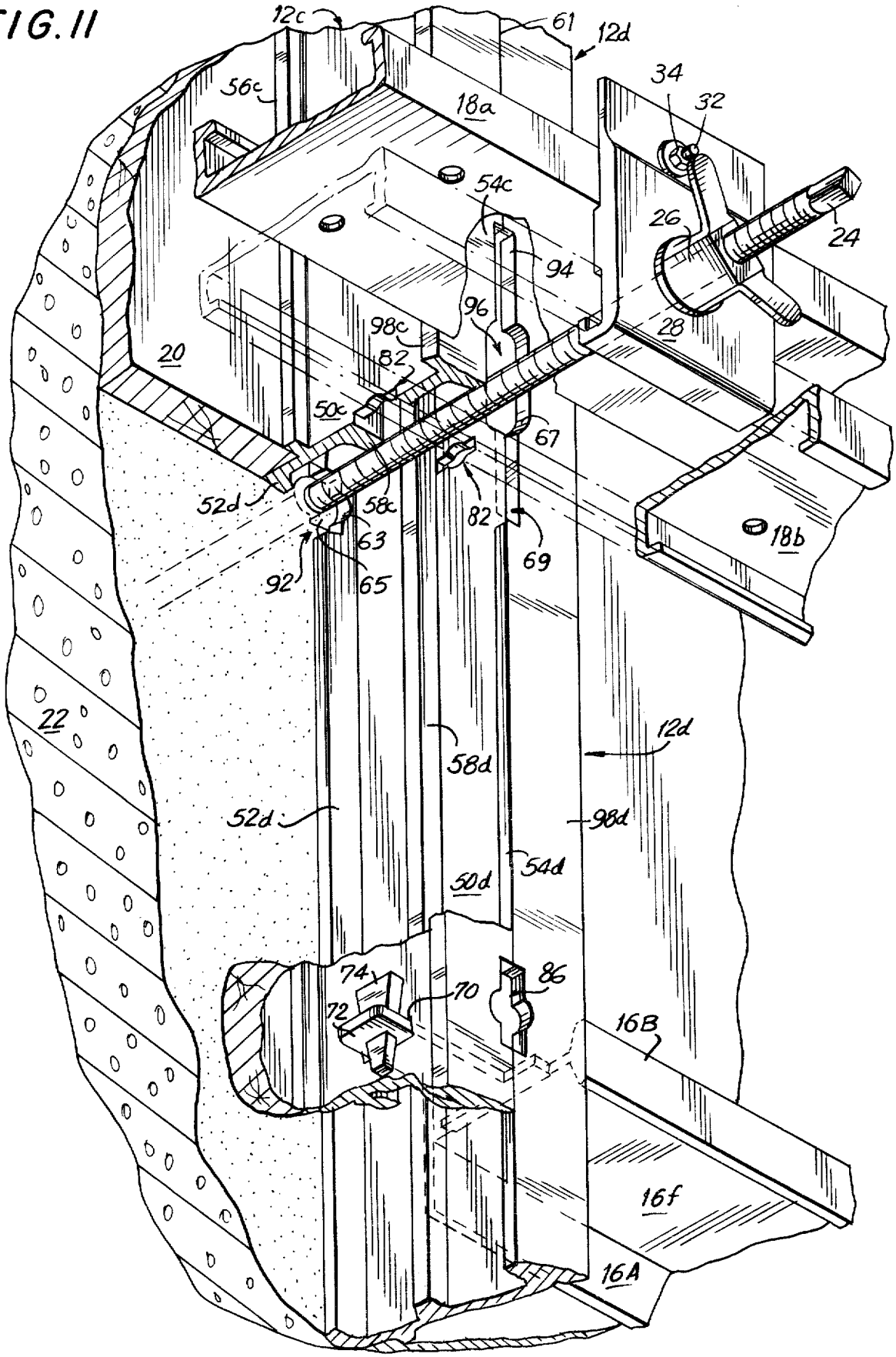

FIG. 11 is a perspective view of a portion of the prefabricated modular unit of the invention with portions broken away to show its use with yet another thicker conventional screw taper tie rod.

Numeral 10 in FIG. 1 refers generally to a series of ganged prefabricated modular units connected to one another to form a concrete wall form assembly. About half of two modular units 11*a* and 11*b* are shown on the left and on the right side of FIG. 1, respectively. The first modular unit, 11*a*, consists of side rails (or vertical panel members) 12*b* and 12*c*, end rails (see horizontal bottom panel member 14*a*) and stiffening ribs (i.e., intermediate bracing members) 16*a*, 16*b* and 16*c*. Similarly, the second modular unit 11*b* is defined by side rails 12*d* and 12*e*, end rails 14*b*, ribs 16*d*, 16*e* and 16*f*.

The two modular units 11*a* and 11*b* are connected to one another by means of rails 12*c* and 12 *d* as is further described below. Side rails 12*b* and 12*e* are, in turn, attached to adjacent side rails 12*a* and 12*f* of additional modular units. These modular units form very strong ganged structures; however, they can be further connected and backed by load-gathering walers 18 (shown as back-to-back U-shaped channels 18*a* and 18*b*). For a more detailed description of such walers (wooden, aluminum, etc.) see one of the applicants' copending application Ser. No. 225,202. Each of the two modular units 11*a* and 11*b* is provided with a pair of handles 19 (only one shown) which facilitates lifting of the complete unit during erection and dismantling. The handles 19 are symmetrically fixed to the second rib (e.g. 16*b*) and the sixth rib (not shown) of each unit. Reference numberal 20 identifies the plywood facing sheets which form the operative forming surfaces of the form. The stiffening of the frame formed by the end rails 14 and the side rails 12 is aided by the gussets 17, which also serve to support the sheet 20. Support tabs 36 on the end rails 24 aid in the latter function.

With reference to FIG. 2, reference numeral 22 identifies concrete poured and set between the form assemblies. Those assemblies are interconnected by means of a tie rod 24 which extends between the two forms and through kerf-defined holes provided in side rail 12*c* as further described below. Tie rod placement could equally well be between end rails 14. Tie rod 24 is threaded at its outer ends and a locking wing nut 26 is provided for increasing or decreasing the tension in the tie rod and between the wall forms. Walers 18*a* and 18*b* are retained by means of a tie plate 28, clip 30 and locking bolt 32 and nut 34.

As shown most clearly in FIGS. 7, 8 and 11, the improved prefabricated modular units are constructed from mating, channel-shaped members (i.e. side rails 12 or end rails 14). The channel members are preferably made of aluminum (or other extruded light weight metal). With particular reference to FIG. 7, the side rail 12*c* includes a web 50*c*, an interior end flange 52*c*, an outer exterior flange 54*c*, (an inner exterior flange 98*c*), and a plywood retaining flange 56*c*. Interior end flange 52*c* and plywood retaining flange 56*c*, together, position and support plywood facing 20. Interior and exterior flanges, 52*c*, 54*c*, abut and mate with interior and exterior flanges 52*d* and 54 *d* of the mating panel member 12*d*. Such mated alignment is shown by reference numerals 59 and 61 in FIGS. 8 and 11. Panel members 12*c* and 12*d* also include median flanges 58*c* and 58*d*, respectively, also known as "distance fingers", which extend inwardly towards one another and define a space through which tie rod 24 passes. One significant purpose of median flanges 58*c* and 58*d* is to aid by means of the sloping surfaces 88*c* and 88*d* during the blind insertion of the tie rod 24 to guide it as it is passed through the structural member comprised of mating panel member 12*c* and 12*d* (and prevent its being caught behind flanges 54*c* or 54*d*, instead of passing through recess hole 96). Equally significant purposes of the median flanges are discussed below with respect to FIG. *7a*.

As shown most clearly in FIGS. 2, 3, 4, 7 and 11, the interior flanges 54*c* and 54*d* each have at least one kerf 90 thereon dimensioned so that the mating flanges define a recess 92 which permits through-passage of a tie rod 24 of any available cross section. As shown in the drawings, the recess is preferably of a universal shape, i.e. it has both a rounded portion 63 and a rectangular portion 65, so as to form a universal slot 92. To applicants' knowledge, such a slot has never before been used to accommodate different types of tie rods. Typically, the rails 12 and 14 will have a plurality of such slots defined along their length so as to permit passage of tie rods at a number of points.

The outer exterior flanges 54*c* and 54*d* are each provided with at least one longitudinally extending kerf 94 dimensioned so that when rails 12*c* and 12*d* are mated, a longitudinally extending recess 96 is provided in the said exterior flanges. The recess 96 is substantially longer than the universal slot 92 which is formed in the interior flanges and may have a rounded portion 67 the diameter of which is typically greater than the longest commercial round tie rods commonly available and have an extended rectangular slot 69 (for use with flat tie rods) extending along the length of the exterior flanges.

The purpose of the longitudinally extending recess 96 defined by the kerfs 94 in the mating exterior flanges are twofold. Firstly, the extended slot accommodates a substantial degree of movement of tie rod 24 vertically, to accommodate displacements of the form walls from the vertical due to canting of the opposing forms 11 and 11' from true parallel (as when forming a wall with a thicker base). Secondly, the extended slot is a substantial aid in break back operations because when using flat tie rod 44, from which the walers have been removed, can be displaced in the elongated recess and will break off at their weakened portions 46 just beneath the surface of the concrete (thus facilitates later form stripping from the set concrete).

It will be appreciated that end rails 14 except for size and lack of ribs are essentially identical to side rails 12; so that the mocular units can be stacked upon one another as well as erected side by side as described. The kerfs in the mating flanges thereof also define holes and slots for tie rods.

For the first time in this art, the present invention by providing for the use of deep flanges successfully accommodates any of the standard commercial tie rods, regardless of type and size. The universally-shaped recesses also aid in this. It is well known in the art to employ round as well as flat tie rods. These may be flat ties, loop ties, pencil rod ties, taper ties or other conventional ties as are well known in the art. FIG. 5 discloses a form of loop tie which includes the tie rod itself 38, a threaded, adjustable end piece 39 on both sides thereof and a loop hook 42 adapted to receive a retaining bolt. A similar welded loop tie 80 is more fully described below in connection with FIG. *7a*. The tie rod of FIG. 5 also includes a sheath 40 through which the tie rod passes. Sheath 40 and tie rod itself are sacrificed in the cast concrete.

In FIG. 6, reference numberal 44 refers to a flat tie which has nips 46 therein which facilitate break back operations as described above and slots 48 adapted to receive retaining bolts and the like. It will be understood from the drawings that the universal-shaped hole formed by the mating interior flanges of the panel members and the universal-shaped hole and longitudinal recess formed by the mating exterior flanges permit tie rods of any configuration and cross section to be employed.

It is an important feature of the invention to insure that the interior and exterior flanges of the panel member, 52, 54, and 48 are sufficiently wide as to provide an overall I-beam shape for sufficient strength when made from aluminum, and also to provide substantial face for abutting the concrete wall and the horizontal bracing members, respectively. By dimensioning the flanges sufficiently so that the compression load developed when the tie rods are tightened down is distributed over a substantial area, permits the use of a lesser number of larger tie rods to create the same concrete wall form assembly. It will be appreciated by those skilled in the art that the major cost of erecting concrete form assemblies is in the labor to erect them and that material costs are less significant. The invention achieves a reduction in the total number of tie rods for a given wall area thus reducing labor costs, and also guarantees integrity of the wall form structure.

The improved rails of the invention are tied to one another by conventional means, (such as by T-bolt and wedge assemblies as shown in FIGS. 7*a*, 8, and 11). A plurality of universal-shaped holes 70 are provided in the web portions 50 of the panel members. A T-bolt 72 is passed through the webs of adjacent panel members when in their mating position and a wedge 74 is inserted in the aperture in the end of bolt 72 to secure the panel members to one another. The T-bolt 72 can also be used via recess 86 to anchor accessories, such a gang waler rods, etc.

FIG. 8 also shows details of the inter-connection of ribs 16 and rails 12, the former being attached to the latter at welds 75. A rib 16 is shown in cross section in FIG. 9, with extended flange 16A (against which plywood sheet 20 abuts) and with end flange 16B (which is coterminus with the exterior end flange 54 of the panel member).

FIG. 7*a* describes another embodiment of the invention wherein a loop-type tie rod 80 engages a wedge bolt 81 extending through universal-shaped holes **82*c* and 82*d* in panel members 12*c* and 12*d*, respectively. The wedge bolt 81 is locked in place by wedge bolt 81*a*. This illustrates two additional significant advantages deriving from the median flange 58. First, it acts as a distance finger centrally positioning the tie rod 80 so that the heavy load conveyed by the rod is not unevenly transmitted to one side rail or the other. Secondly, the median flange 58 gives needed strengthening to back up the bolt 81 (preventing elongation of hole 82 and/or failure of web 50**). In prior art aluminum panels of this type in existence for some 20 years, costly seal bushings were used to prevent such failure, and only narrow flanges were used so that only flat or wire tie rods could be employed.

Note that the tie rods 24 (being the most heavily loaded members) are located remote from the ribs 16 to avoid the "heat affected zone" which would reduce the load capacity of the aluminimum structure (i.e. rail) at the weld point.

What is claimed is:

1. A panel member for construction of gang form sections, said panel member being adapted as further defined to operatively mate with a second such panel member to form a structural element of said gang form, and comprising a channel shaped member including, (a) a web, (b) interior and exterior end flanges extending along the length of a mating side of said web, (c) a median flange extending along the length of the mating side of said web on a line intermediate said end flanges, said median flange being narrower than said end flanges, (d) retaining means associated with said interior flange to retain a plywood facing sheet, and (e) means in said web disposed adjacent said median flange on the side thereof away from said retaining means and adapted to receive a locking bolt for securing mating panels to one another, said interior end flange having at least one kerf therein dimensioned so as to form one side of a recess when mated with a second panel having such kerf, said recess permitting through-passage of a tie rod, and said exterior flange having at least one longitudinally extending kerf therein dimensioned so as to form one side of a longitudinally extended recess when mated with a second panel having such longitudinaly extending kerf, said longitudinally extended recess permitting through-passage of a tie rod and the longitudinal extension of said recess permitting said tie rod to be displaced along the axis of said panel.

2. A structural element of a concrete form assembly comprised of two mating panel members, each of said panel members comprising (a) a web, (b) interior and exterior end flanges extending along the length of a mating side of said web, the end flanges contacting the respective flanges of a mating panel member, (c) a median flange extending longitudinally along the mating side of said web on a line intermediate said end flanges and being narrower than said end flanges, the median flanges on said mating panels defining a longitudinal gap between the mating sides of the webs of said panels in the interior thereof, said gap being sufficiently large to permit through-passage of a tie rod, (d) a flange associated with said interior flange to retain a plywood facing sheet, and (c) universal aperture means in said web adapted to receive a T-bolt for securing said mating panels to one another, said aperture means being disposed adjacent said median flange on the side thereof away from said interior flange, said interior end flanges having a plurality of longitudinally spaced kerfs therein dimensioned so that in mating relationship they form a plurality of recesses dimensioned so as to permit through-passage of a tie rod, and said exterior flanges having a plurality of longitudinally extending kerfs therein dimensioned so that in mating relationship the kerfs on mating panels form a plurality of longitudinally extended recesses, said recesses permitting through-passage of a tie rod and the longitudinal extensions permitting said tie rod to be displaced along the axis of said panel.

3. A prefabricated modular unit for a concrete wall form assembly comprising (1) two parallel, spaced apart panel members, each of said panel members being adapted to mate with a panel member of a second modular unit and comprising (a) a web, (b) interior and exterior end flanges extending along the length of a mating side of said web, the said flanges contacting the respective flanges of the mating panel member, (c) a median flange extending longitudinally along the mating side of said web on a line intermediate said end flanges and being narrower than said end flanges, the median flanges on said mating panels defining a longitudinal gap between one another in the interior of said mating panels, said gap being sufficiently large to permit through-passage of a tie rod, (d) a flange associated with said interior flange to retain a plywood facing sheet, said interior end flanges having a plurality of longitudinally spaced kerfs therein dimensioned so that in mating relationship they form a plurality of recesses dimensioned so as to permit the through-passage of a tie rod, and (e) universal aperture means in said web adapted to receive a T-bolt for securing said mating said interior end flanges having a plurality of longitudinally spaced kerfs therein dimensioned so that in mating relationship they form a plurality of recesses dimensioned so as to permit through-passage of a tie rod, said universal aperture means being disposed adjacent said median flange on the side thereof remote from said interior flange, and said exterior flanges having a plurality of longitudinally extending kerfs therein dimensioned so that in mating relationship the kerfs on mating panels form a plurality of longitudinally extended recesses, said recesses permitting through-passage of a tie rod and the longitudinally extended recesses extended recesses permitting said tie rod to be displaced along the axis of said mating panels joined to one another, and (2) a plurality of bracing members attached at each end to each of said panel members and passing perpendicularly between said members.

4. A prefabricated modular unit for a concrete wall form assembly comprising (1) a first pair of parallel, spaced apart panel members and a second pair of parallel, spaced apart panel members perpendicular to said first pair, said first and second pairs defining a rectangular structure adapted to be interconnected along any of said panels with a second such modular unit by mating the respective panels thereof, said panels comprising (a) a web, (b) interior and exterior end flanges extending along the length of a mating side of said web, the end flanges contacting the respective end flanges of the mating panel member, (c) a median flange extending longitudinally along the mating side of said web on a line intermediate said end flanges and being narrower than said end flanges, the median flanges on said mating panels defining a longitudinal gap between each other in the interior of said mating panels, said gap being sufficiently large to permit through-passage of a tie rod, (d) a flange member associated with said interior flange to retain a plywood facing sheet, and (e) universal aperture means in said web adapted to receive a T-bolt for securing said mating said interior end flanges having a plurality of longitudinally spaced kerfs therein dimensioned so that in mating relationship they form a plurality of recesses dimensioned so as to permit through-passage of a tie rod, said universal aperture means being disposed adjacent said median flange at the side thereof remote from said interior flange, and said exterior flanges having a plurality of longitudinally extending kerfs therein dimensioned so that in mating relationship the kerfs on mating panels form a plurality of longitudinally extended recesses, said recesses permitting through-passage of a tie rod and the longitudinal extensions permitting said tie rod to be displaced along the axis of said mating panels joined to one another, and (2) bracing means extending between said panels.

* * * * *